United States Patent [19]

Furuyama et al.

[11] Patent Number: 4,975,263

[45] Date of Patent: Dec. 4, 1990

[54] PROCESS FOR PRODUCING MESOPHASE PITCH-BASED CARBON FIBERS

[75] Inventors: Masatoshi Furuyama; Yasunori Sajiki; Takeshi Hamada; Tadao Tomioka, all of Kawasaki, Japan

[73] Assignees: Nippon Steel Corporation; Nippon Steel Chemical Co., Ltd., both of Tokyo, Japan

[21] Appl. No.: 303,654

[22] Filed: Jan. 30, 1989

[30] Foreign Application Priority Data

Feb. 5, 1988 [JP] Japan ..... 63-23891
May 26, 1988 [JP] Japan ..... 63-127107

[51] Int. Cl.[5] ..... D01F 9/12

[52] U.S. Cl. ..... 423/447.7; 423/447.1; 423/447.4; 423/447.6; 264/29.2

[58] Field of Search ..... 423/447.1, 447.2, 447.4, 423/447.6, 447.7; 264/29.2

[56] References Cited

U.S. PATENT DOCUMENTS

| | | | |
|---|---|---|---|
| 3,552,922 | 1/1971 | Ishikawa et al. | 423/447.4 |
| 4,005,183 | 1/1977 | Singer . | |
| 4,265,869 | 5/1981 | Kaji et al. | 423/447.2 |
| 4,314,981 | 2/1982 | Miyamori et al. | 423/447.7 |
| 4,389,387 | 6/1983 | Miyamori et al. . | |
| 4,454,019 | 6/1984 | Izumi et al. | 423/447.2 |
| 4,576,810 | 3/1986 | Redick | 423/447.1 |
| 4,686,096 | 8/1987 | Schulz et al. | 423/447.1 |
| 4,762,652 | 8/1988 | Miyamori et al. | 423/447.7 |

FOREIGN PATENT DOCUMENTS

| | | | |
|---|---|---|---|
| 2006524 | 8/1970 | Fed. Rep. of Germany | 423/447.7 |
| 47-40093 | 10/1972 | Japan | 423/447.7 |
| 48-42696 | 12/1973 | Japan . | |
| 60-259629 | 12/1985 | Japan . | |
| 61-34226 | 2/1986 | Japan | 423/447.4 |
| 61-225330 | 10/1986 | Japan . | |
| 62-104927 | 5/1987 | Japan . | |

*Primary Examiner*—Olik Chaudhuri
*Assistant Examiner*—Robert M. Kunemund
*Attorney, Agent, or Firm*—Wenderoth, Lind & Ponack

[57] ABSTRACT

A process for producing a carbon fiber by subjecting a pitch fiber, obtained by melt spinning a carbonaceous mesophase pitch, to stabilization, followed by a carbonization or graphitization treatment, wherein the stabilization is carried out under an oxidative atmosphere containing 0.1% to 40% by volume of $NO_2$ and 4% to 40% by volume of $H_2O$ at a temperature of from 100° C. to 400° C.

6 Claims, 1 Drawing Sheet

PROCESS FOR PRODUCING MESOPHASE PITCH-BASED CARBON FIBERS

BACKGROUND OF THE INVENTION

1. Field of the Invention

The present invention relates to a process for producing mesophase pitch-based carbon fibers. More specifically, it relates to a novel stabilizing method which is intended to improve the strength and the efficiency of the stabilization of the mesophase pitch-based carbon fibers.

2. Description of the Related Art

Currently, mainly PAN (polyacrylonitrile)-based carbon fibers are used for composite materials, but the PAN-based carbon fibers are expensive, because the starting PAN fibers are expensive, and have a low carbon yield, and therefore, have been used mostly in special fields related to sports and leisure, or aeronautics and space.

Conversely, pitch-based type carbon fibers obtained from carbonaceous pitch as the starting material have the specific features of a low cost production, because the starting material is inexpensive, and has a high carbon yield. Particularly, mesophase pitch-based carbon fibers obtained from a mesophase pitch containing 40% or more of mesophase, preferably 60% or more of mesophase as the starting material are now attracting attention as inexpensive materials which may provide high performance carbon fibers. With regard to mesophase pitch-based carbon fibers, it is commonly known that carbon fibers having a high preferred orientation and a high graphitizability can be easily produced, and therefore, fibers having a high Young's modulus can be produced. For example, Japanese Unexamined Patent Publication (Kokai) No. 49-19127 discloses mesophase pitch-based carbon fibers having a structure possessing the three-dimensional order characteristics of polycrystalline graphite, a high graphitizability, and an excellent modulus, and processes for producing same. Nevertheless, although such carbon fibers having a high graphitizability have a high Young's modulus, they have a drawback in that the tensile strength and the elongation at break are low. Accordingly, it is considered difficult to improve the tensile strength of mesophase pitch-based carbon fibers, even though it has an excellent Young's modulus.

Recently, various attempts have been made to improve the tensile strength of the mesophase pitch-based carbon fibers by controlling the structure thereof. For example, Japanese Unexamined Patent Publication (Kokai) No. 62-104927 discloses that mesophase pitch-based carbon fibers having a lower graphitizability can be produced by stirring at a location immediately above the capillary of the spinning nozzle in the spinning, thereby producing a finer structure in the cross-sectional direction while maintaining a high preferred orientation in the axial direction, and that the tensile strength of the carbon fibers can be improved while maintaining a high Young's modulus. Investigations into an improvement of mechanical properties by a structural control of the mesophase pitch-based carbon fibers, however, have been primarily concerned with the spinning, and no reports have been given regarding the stabilization, carbonization, and graphitization. Also, the structural control in the mesophase pitch-based carbon fibers of the prior art is intended to provide a macroscopic structural control or a microscopic structural control of the whole parts of fiber, and no reports have been made of attempts to improve the mechanical properties by a microscopic structural control of a specific site, for example, by changing the structure of the surface layer of the fiber or changing the structure of the center portion.

For PAN-based carbon fibers, an attempt has been made to improve the mechanical properties by subjecting the fiber to electrolytic oxidation after a carbonization treatment, and then applying a heat treatment thereto in an inert gas, to thereby control the microscopic structure of the ultra-thin outermost layer of the fibers (Japanese Unexamined Patent Publication (Kokai) No. 61-225330). Nevertheless, investigations by the present inventors found that, even if this method is applied to the mesophase pitch-based carbon fibers, the mechanical properties can not be improved, and in some cases, the tensile strength was lowered. This may be considered to be due to the great difference in the structures of the PAN-based carbon fibers and the mesophase pitch-based carbon fibers.

Regarding the stabilization of pitch fibers, this is usually carried out in an oxidative atmosphere at a temperature of 100° C. to 400° C. Particularly, it is most usual to use air or a gas mixture of oxygen and nitrogen as the oxidative atmosphere, although attempts have been made to employ another oxidative gas such as nitrogen oxide as the oxidative atmosphere. The main purpose for these attempts was not primarily to improve the mechanical properties of the carbon fibers, but to shorten the treatment time. This is because the stabilization process is time consuming. For example, it takes a relatively longer treatment time of about 60 to 400 minutes in an air atmosphere. Particularly, in the case of an isotropic pitch-based carbon fibers, a prolonged treatment is required because the treatment must commence from a lower temperature at the initial stage of the stabilization. Japanese Patent Publication (Kokoku) No. 48-42696 discloses an example in which $NO_2$ was used in the stabilization of the isotropic pitch-based carbon fibers, in which the treatment was conducted at a lower temperature of 30° C. to 130° C. and the treatment time was shorter than that for treatment using air. Also, as an example of an application of the mesophase pitch-based carbon fiber, Japanese Unexamined Patent Publication (Kokai) No. 60-259629 discloses a stabilizing treatment in an oxidative atmosphere such as air or oxygen containing 0.1% to 50% by volume of $NO_2$, at a treatment temperature of 150° C. to 380° C. It is shown that a treatment time reduction and improvement of mechanical properties of the carbon fiber are obtained by this treatment. However, the present inventors found that the stabilization using of an oxidative atmosphere containing $NO_2$ at a lower temperature of 100° C. to 260° C. is effective for a reduction of treatment time, but provides little improvement of the physical properties of the carbon fiber, and that the use of an oxidative atmosphere such as air or oxygen containing $NO_2$ at a higher temperature of 260° C. to 380° C., results in a high oxidative consumption of the fibers, thereby causing a lower yield. Further, when an extreme oxidative consumption damages fibers, a problem arises also in that the mechanical properties may be lowered.

Therefore, in the stabilization of the masophase pitch-based carbon fibers, there are no reports on a method of controlling the structure of a carbon fiber, and the improvement of the stabilization rate is not satisfactory.

SUMMARY OF THE INVENTION

Accordingly, the object of the present invention is to develop a stabilizing method by which the strength of the mesophase pitch-based carbon fibers can be improved and the stabilizing treatment time can be shortened.

Other objects and advantages of the present invention will be apparent from the following description.

In accordance with the present invention, there is provided a process for a stabilization of pitch fibers obtained by a melt spinning of carbonaceous mesophase pitch, which comprises treating the fibers in an oxidative atmosphere containing 0.1% to 40% by volume of $NO_2$ and 4% to 40% by volume of $H_2O$, at a temperature of 100° C. to 400° C.

BRIEF DESCRIPTION OF THE DRAWING

The present invention will be better understood from the description set forth below with reference to the accompanying drawing of FIG. 1, graphically showing an example of the relationship between the treatment time at 300° C. and the O/C(EA) and the O/C(ESCA) of the stabilized fibers when the stabilization was effected in air containing 5% $NO_2$ and in air containing 5% $NO_2$ and 10% $H_2O$.

DESCRIPTION OF THE PREFERRED EMBODIMENTS

Figure 1:
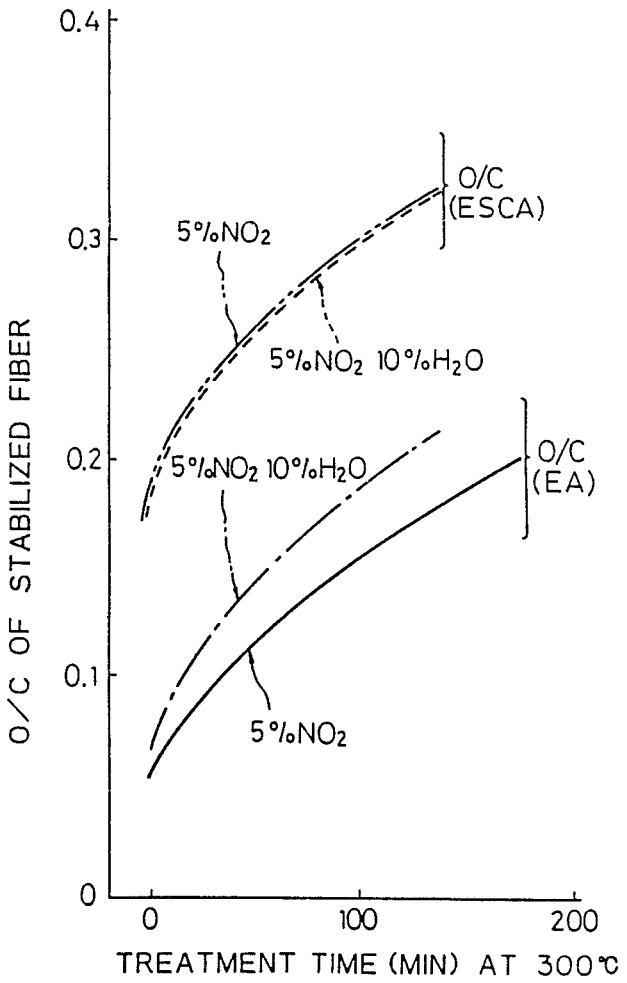

The present inventors found that, to improve the strength of the mesophase pitch-based carbon fibers, a treatment of the surface layer of the fiber and the production of a carbon fiber having a different structure at the central portion and at the surface layer are important. The present inventors also found that such a fiber can be effectively produced by a reaction capable of an optimal control of the degree of oxidation of the central portion and the surface layer in the stabilization, and that the use of an oxidative atmosphere containing $NO_2$ and $H_2O$ is suitable for this purpose, and further, the stabilization rate can be improved. Thus the present invention was accomplished on the basis of these findings.

By the stabilization of the present invention, a stabilized fiber having a well balanced degree of oxidation between the surface layer and the central portion can be produced and the treatment time can be shortened. Further, by subjecting the stabilized fibers to carbonization or graphitization, a mesophase pitch-based carbon fibers which have different microscopic structures between the surface layer and the central portion of the carbon fiber and have an excellent strength, can be produced.

Also, to improve the tensile strength, the stabilization is preferably carried out until the atomic ratio of oxygen to carbon O/C(ESCA) determined from the area ratio (Ols/Cls) of the Ols peak to Cls peak, detected by measuring the stabilized fiber surface by X-ray photoelectric spectroscopy (ESCA), becomes 0.19 to 0.30, and the ratio R of O/C(ESCA) to the atomic ratio O/C-(EA) determined from elemental analysis values becomes 1.5 or more.

Various methods have been proposed in the prior art for an stabilization of the pitch-based carbon fibers, and the method most generally practiced is that in which an oxidation treatment is carried out in an oxygen-containing atmosphere, such as air. Further, there has been proposed a method in which the stabilization is carried out in a oxidative atmosphere such as air containing $NO_2$ as the oxidative gas. According to this method, advantages are gained in that (1) the stabilizing atreatment rate is improved, and (2) the strength of the carbon fiber is improved. The present inventors investigated the stabilization under an oxidative atmosphere such as air containing $NO_2$, and found that the oxidation of the surface layer is faster than that of the central portion of the fiber, and thus a stabilized fiber having different degrees of oxidation at the surface layer and at the central portion is formed, and further found that the oxidation at the surface layer and at the central portion can be controlled to optimum degrees by adding $H_2O$ to the oxidative atmosphere such as air containing $NO_2$, whereby the efficiency of the stabilization can be further improved.

The stabilization of pitch fiber is a solid phase oxidation reaction, and it is thought that there is a difference in the reaction rate of the fiber surface layer and the central portion. The degrees of oxidation at the surface layer and the central portion can be evaluated from the value of the atomic ratio O/C(EA) of oxygen to carbon, determined from elemental analysis values of the stabilized fiber, and the value of the atomic ratio O/C-(ESCA) of oxygen to carbon of the fiber surface obtained by measurement of the stabilized fiber surface by X-ray photoelectric spectroscopy.

Here, O/C(EA) is a numerical value indicating an average degree of oxidation of the fiber, and O/C-(ESCA) indicates the degree of oxidation of the surface layer to a depth of about 0.01 μm from the fiber surface. FIG. 1 shows the relationship between the treatment time at 300° C. and O/C(EA) or O/C(ESCA) when air containing 5% by volume of $NO_2$ and air containing 5% by volume of $NO_2$ and 10% by volume of $H_2O$ are used as the stabilizing atmosphere. When the stabilization was effected with air containing 5% by volume of $NO_2$, the value of O/C(ESCA) of the stabilized fibers was larger than that of O/C(EA) (i.e., the degree of oxidation at the surface layer was larger). Therefore, the cause of the improvement of the strength of a carbon fiber when using $NO_2$ may be considered to be that the degree of oxidation at the surface layer is higher than that at the central portion. Nevertheless, investigations by the present inventors showed that, when the stabilization is effected with the air containing $NO_2$, since oxidation of the surface layer is too rapid compared with that at the central portion, an excessive oxidation of the surface layer is required to ensure an adequate oxidation of the central portion, and thus the problem of a lower yield arises. When the stabilization is performed in an atmosphere in which $H_2O$ is added to the air containing $NO_2$, as shown in FIG. 1, the oxidation rate at the central portion, which is slow when the stabilization is performed in air containing $NO_2$, can be improved, and accordingly, an improved stabilizing rate and an improved yield were achieved, and further the tensile strength of the carbon fiber was improved. The mechanism of the improvement of the oxidation rate at the central portion when $H_2O$ is added is not absolutely clear, and the reasons for the improvement of the tensile strength of the carbon fiber remain obscure. However, it may be considered that the fibers stabilized with the air containing only $NO_2$, but $H_2O$, are injured at the surface for excessive oxidation, and thus, the strength of the obtained carbon fibers is reduced. The reason why the tensile strength of the carbon fibers is improved by using the present method may be considered due to an optimization of the degrees of oxidation of the surface layer and the central portion of the fiber, respectively.

As the starting material pitch for the carbon fiber, any pitch, including coal-derived pitches such as coal tar pitch and residue of coal liquefied oil, and petroleum-derived pitches such as residue of ethylene tar and decant oil pitch are available. Also, various modifications of the above pitches, for example, those subjected to hydrogenation modified by heat treatment, subjected to solvent fractionation, fractionation by distillation, or modified by a combination of these methods, can be used. The carbonaceous mesophase pitch to be used in the present invention contains an optical anisotropic phase (mesophase) obtained by a heat treatment of the pitch, and the ratio of the optical anisotropic phase is preferably 40% or higher, more preferably 60% or higher, in order to give the carbon fiber obtained a high strength and a high modulus. The carbonaceous mesophase pitch to be used in the present invention preferably has a softening point of 240° C. to 340° C., from the viewpoint of spinnability.

The pitch fiber is obtained by melt spinning the above-mentioned carbonaceous mesophase pitch by a known method. For example, the carbonaceous mesophase pitch is melted at a temperature higher than the softening point thereof, extruded through a nozzle 0.05 to 0.5 mm in diameter at a viscosity of from 100 to 3000 poise (P), and span at 50 to 1000 m/min. to obtain a pitch fiber. The nozzle used is not limited to a circular shape, and various structures such as angular nozzles and nozzles having an enlarged or reduced pathway may be used.

Next, the pitch fiber is stabilized in an oxidative atmosphere containing 0.1% to 40% by volume $NO_2$and 4% to 40% by volume of $H_2O$. Here, preferably the atmosphere contains 1% to 10% by volume of $NO_2$, 4% to 20% by volume of $H_2O$, and 2% to 40% by volume of $O_2$, with the balance being substantially an inert gas such as other nitrogen. Ozone, nitrogen oxides, $HNO_3$, halogen, and sulfur oxides also may be co-present therein.

When the $NO_2$ content in the atmosphere gas used for the stabilization is less than 0.1% by volume, the promotion of the degree oxidation of surface layer of fiber is unsatisfactorily small, and if the content exceeds 40% by volume, the fiber is undesirably susceptible to excessive oxidation due to the rapid oxidation rate. On the other hand, when the $H_2O$ content is less than 4% by volume, the improvement of the oxidation rate at the central portion of the fiber is unsatisfactorily small, and if the content exceeds 40% by volume, no improvement in the physical properties of the carbon fiber is obtained. The content of $O_2$ is not particularly limited, but if less than 2% by volume, the treatment time is undesirably prolonged because the stabilization rate is slower, and if more than 40% by volume, the fiber is susceptible to excessive oxidation due to the rapid oxidation rate. Here, air can be economically used as the $O_2$ source, and if necessary, the $O_2$ content can be made higher, for example, 21% to 40% by volume, by adding $O_{02}$ gas to the air, and conversely, the $O_2$ content can be made lower, for example, 2% to 21% by volume, by adding $N_2$ gas to the air.

The atmospheric gas containing $NO_2$ and $H_2O$ can be industrially produced by a known method, for example, mixing ammonia with a gas containing oxygen, such as air, and oxidizing the ammonia.

To explain the method in more detail, ammonia is mixed with a gas containing oxygen, such as air, and the ammonia is oxidized on a platinum catalyst to form NO, then the NO is then further oxidized by a gas containing oxygen, such as air, at a predetermined temperature to form $NO_2$. This method has an advantage in that a gas containing both $NO_2$ and $H_2O$ can be produced. Also, by varying the mixing ratio of the ammonia and the gas containing oxygen, such as air, or diluting the formed gas with a gas such as air, the $NO_2$ concentration can be easily controlled. The gas produced by this method can be used as the gas containing $NO_2$ and $H_2O$ , and if necessary, humidification or dehumidification can be effected to obtain a suitable $H_2O$ concentration.

The stabilization is preferably done at a temperature from 100° C. to 400° C., more preferably from 150° C. to 350° C. If the temperature is too low, the treatment time is prolonged, and if the temperature is too high, phenomena such as fusion among the fiber and/or oxidation consumption of the fibers undesirably occur. Preferably, when the stabilization is carried out in a gas phase, the treatment is initiated at a temperature at which a fusion of the pitch fiber does not occur, for example, a temperature of about 100° C. to 250° C., and the temperature is increased in accordance with the progress of the reaction to a temperature of, for example, about 250° C. to 400° C., and maintained at that temperature. A similar method may be employed in the present invention, but a preferable method comprises initiating the stabilization at a temperature of 250° C. or lower, elevating the temperature in accordance with the progress of the reaction to 260° C. to 350° C., and maintaining that temperature, until the fiber convert to be infusible.

Further, preferably the stabilizattion is carried out until the O/C(ESCA) of the stabilized fiber surface becomes 0.19 to 0.30, and R becomes 1.5 or more. When the O/C(ESCA) is less than 0.19, the surface oxidation is insufficient, and when higher than 0.30, undesirable oxidation consumption of the surface occurs.

The stabilized fiber thus obtained can be heat-treated at a temperature of 1000° C. to 2000° C. in an inert gas atmosphere of $N_2$ or Ar, for carbonization, or subsequently at a temperature of 2000° C. or higher for graphitization. Thus, a carbon fibers are obtained.

By the stabilizing method according to the present invention, the stabilized fiber has a higher degree of oxidation at the fiber surface layer than that at the central portion, and by further subjecting the stabilized fibers to carbonization or graphitization, carbon fibers having an excellent tensile strength can be produced.

The O/C(ESCA), O/C(EA), R, and softening point shown in the present specification are described in detail below.

O/C(ESCA)

An X-ray photoelectron spectroscopic method (ESCA) is used to measure the O/C (ESCA). The fibers to be measured are carefully shortened so that the surface of the fiber is not contaminated, and juxtaposed by spreading on a sample supporting stand made of stainless steel. The sample chamber is internally maintained at $5\times10^{-7}$ torr or lower, and MgK$\alpha$ is used as the X-ray source. The Ols peak around a bonding energy of 532 eV and Cls peak around 284 eV are measured, and the area ratio (Ols/Cls) is determined. The atomic ratio of oxygen to carbon O/C(ESCA) is determined from the (Ols/Cls) by the following formula (1):

$$O/C(ESCA) = 1/2.9 \times (Ols/Cls) \quad (1).$$

Wherein the value of the ratio of the relative sensitivity of the Ols peak and the Cls peak is 2.9.

The O/C(ESCA) value determined by ESCA is used as an index to show the degree of oxidation of the surface layer to a depth of about 0.01 μm from the fiber surface.

O/C(EA)

This indicates the atomic ratio of oxygen to carbon determined by an elemental analysis of the fiber, and is calculated from the formula (2):

$$O/C(EA) = \frac{\text{Elemental analysis value of oxygen (wt. \%)}}{\text{Atomic weight of oxygen}} \times \frac{\text{Atomic weight of carbon}}{\text{Elemental analysis vlaue of carbon (wt. \%)}} \quad (2)$$

Namely, O/C(EA) represents the average degree of oxidation of the whole fiber.

R

R is a number defined by the formula (3), and indicates the ratio of the degree of surface oxidation to the average degree of oxidation.

$$R = (O/C(ESCA)) / (O/C(EA)) \quad (3).$$

SOFTENING POINT

The softening point of the pitch in the present specification is the temperature at which the apparent viscosity measured by the capillary rheometer is 20000 poise. Where the capillary used is 0.3 mm in diameter and 0.3 mm in length, and the pitch is extruded by the constant pressure of 10 kgf/cm$^2$.

EXAMPLES

The present invention will now be further illustrated by, but is by no means limited to, the following Examples, wherein all percentages are expressed on a weight basis unless otherwise noted.

EXAMPLES 1 AND 2 AND COMPARATIVE EXAMPLES 1 AND 2

A coal tar mesophase pitch containing 85% optical anisotropic phase (mesophase), 78% toluene insolubles (TI) and 10% quinoline insoluble (QI) was melt spun by using a nozzle 0.2 mm in diameter to obtain pitch fibers having an average diameter of 11 μm. The pitch fibers were maintained at 200° C. for 10 minutes in air containing 5% by volume of $NO_2$ and 10% by volume of $H_2O$, elevated to a temperature of 300° C. at a rate of 10° C./min., and maintained at 300° C. for 0 to 120 minutes to effect the stabilization. The treatment conditions are shown in Table 1, Nos. 1 to 4. The gas used during the stabilization was generated by mixing pure $NO_2$ gas (produced by Seitetsu Kagaku Kogyo K.K.) with air humidified by bubbling through boiling water. A part of the stabilized fibers was used for measurement by elemental analysis and by X-ray photoelectric spectroscopy. And a part thereof was elevated from a room temperature to 2300° C. at a rate of 50° C./min. in an argon gas atmosphere, and maintained at 2300° C. for 15 minutes to effect graphitization. Thus, carbon fibers were obtained. The mechanical properties, etc., of the resultant carbon fiber are shown in Table 1.

It can be seen that the carbon fibers No. 2 and No. 3 have an excellent tensile strength.

On the other hand, Comparative Example No. 1 has a low O/C(ESCA) value of 0.17, and the carbon fiber obtained has a low tensile strength. Conversely, Comparative Example No. 4 has a high O/C(ESCA) value of 0.31, i.e., is excessively oxidized, and therefore the carbon fibers obtained have a small diameter, and thus the yield is low.

COMPARATIVE EXAMPLES 3 to 5

The pitch fiber used in Example 1 was maintained at 200° C. for 10 minutes in air containing 5% by volume of $NO_2$, and then the temperature thereof was elevated to 300° C. at a rate of 10° C./min. and maintained at 300° C. for 0 to 30 minutes, to effect the stabilization.

The treatment conditions are as shown in Table 1, Nos. 11 to 13, and the gas used during the stabilization was generated by mixing pure $NO_2$ gas (produced by Seitetsu Kagaku Kogyo K.K.) with dry air. The measurements of the stabilized fiber were the same as made in Example 1. Also, a part of the stabilized fiber was subjected to the graphitization as in Example 1, to obtain carbon fibers. The mechanical properties of the resultant carbon fiber are shown in Table 1.

When Nos. 1, 2, and 3 are compared with Nos. 11, 12, and 13 in Table 1, it is obvious that the increase of the O/C(EA) is accelerated when $H_2O$ is added, to thereby improve the infusible treatment rate. Also, it can be seen that the strength of carbon fiber is greater when $H_2O$ is added.

COMPARATIVE EXAMPLE 6

The temperature of the pitch fiber used in Example 1 was elevated from 200° C. to 300° C. at a rate of 0.5° C./min. in dry air, and maintained at 300° C. for 60 minutes to effect the stabilization. The stabilized fiber was subjected to the same measurements as described in Example 1. Also, a part of the stabilized fiber was subjected to the same graphitization treatment as in Example 1, to obtain carbon fibers. The mechanical properties of the resultant carbon fiber are shown in Table 1, No. 21.

TABLE 1

| | Infusible treatment conditions | | Analytical values of infusibility treated fiber | | | Form of carbon fiber | Mechanical properties of carbon fiber | | | |
|---|---|---|---|---|---|---|---|---|---|---|
| No. | Atmosphere | Time Kept at 300° C. (min) | O/C (EA) | O/C (ESCA) | R | | Diameter (μm) | Tensile strength (kg/mm$^2$) | Modulus (t/mm$^2$) | Remarks |
| 1 | Air containing 5% $NO_2$ and 10% $H_2O$ | 0 | 0.07 | 0.17 | 2.5 | Good | 9 | 240 | 48 | Comp. Ex.1 |
| 2 | Air containing 5% $NO_2$ and 10% $H_2O$ | 10 | 0.09 | 0.21 | 2.3 | " | 9 | 320 | 47 | Example 1 |
| 3 | Air containing 5% $NO_2$ and 10% $H_2O$ | 30 | 0.12 | 0.26 | 2.2 | " | 9 | 320 | 47 | Example 2 |
| 4 | Air containing 5% $NO_2$ and 10% $H_2O$ | 120 | 0.20 | 0.31 | 1.6 | " | 8 | 290 | 46 | Comp. Ex. 2 |

TABLE 1-continued

| | Infusible treatment conditions | | Analytical values of infusibility treated fiber | | | | Mechanical properties of carbon fiber | | | |
|---|---|---|---|---|---|---|---|---|---|---|
| No. | Atmosphere | Time Kept at 300° C. (min) | O/C (EA) | O/C (ESCA) | R | Form of carbon fiber | Diameter (μm) | Tensile strength (kg/mm²) | Modulus (t/mm²) | Remarks |
| 11 | Air containing 5% $NO_2$ | 0 | 0.06 | 0.18 | 3.0 | Partially Fused | — | — | — | Comp. Ex. 3 |
| 12 | Air containing 5% $NO_2$ | 10 | 0.07 | 0.22 | 3.1 | Good | 9 | 280 | 47 | Comp. Ex. 4 |
| 13 | Air containing 5% $NO_2$ | 30 | 0.09 | 0.26 | 2.9 | " | 9 | 280 | 47 | Comp. Ex. 5 |
| 21 | Air | 60 | 0.09 | 0.09 | 1.0 | " | 9 | 230 | 47 | Comp. Ex. 6 |

EXAMPLE 3

A coal tar mesophase pitch containing 91% optical anisotropic phase (mesophase), 80% toluene insolubles (TI) and 11% quinoline insolubles (QI) was melt spun by using a nozzle 0.2 mm in diameter to obtain a pitch fiber having an average diameter of 11 μm. The pitch fiber was maintained at 200° C. for 10 minutes in air containing 5% by volume of $NO_2$ and 6% by volume of $H_2O$, the temperature thereof elevated to 300° C. at a rate of 10° C./min, and maintained at 300° C. for 10 minutes to effect the stabilization. The gas used was the same as that described in Example 1.

The stabilized fiber had an O/C(EA) of 0.09 and an O/C(ESCA) of 0.22. Further, a part of the fiber was subjected to the same graphitization treatment as in Example 1, to obtain carbon fibers. The carbon fiber had a diameter of 9 μm, a tensile strength of 330 kg/mm², and a modulus of 51 t/mm².

EXAMPLE 4

After the pitch fiber used in Example 3 was maintained at 200° C. for 10 minutes in air containing 10% by volume of $NO_2$ and 10% by volume of $H_2O$, the temperature thereof was elevated to 300° C. at a rate of 10° C./min. and maintained at 300° C. for 10 minutes to effect the stabilization. The gas used for the stabilization was the same as that described in Example 1.

The fiber after the stabilization treatment had an O/C(EA) of 0.10 and an O/C(ESCA) of 0.26. Further, a part of the fiber was subjected to the same graphitization treatment as in Example 1, to obtain a carbon fiber.

The carbon fiber had a diameter of 9 μm, a tensile strength of 340 kg/mm², and a modulus of 51 t/mm².

As described above, the process for producing the carbon fiber of the present invention, by using an oxidative atmosphere containing 0.1% to 40% by volume of $NO_2$ and 4% to 40% by volume of $H_2O$ during the stabilization, improves the stabilization rate and improves the yield, compared with the prior art process. Also, the carbon fiber produced by the process of the present invention has an improved tensile strength, compared with the carbon fiber produced by the prior art process.

What is claimed:

1. A process for producing a carbon fiber by subjecting a pitch fiber obtained by a melt spinning of carbonaceous mesophase pitch to stabilization, followed by carbonization or graphitization treatment wherein the stabilization is carried out under an oxidative atmosphere containing 0.1% to 40% by volume of $NO_2$ and 4% to 40% by volume of $H_2O$ at a temperature of from 100° C. to 400° C.

2. A process for producing a carbon fiber as claimed in claim 1, wherein the atomic ratio of oxygen to carbon O/C(ESCA) determined from an area ratio (Ols/Cls) of the Ols peak to Cls peak detected by measuring the stabilized fiber surface by X-ray photoelectric spectroscopy (ESCA) is 0.19 to 0.30, and the ratio R of O/C-(ESCA) to the atomic ratio O/C(EA) determined from elemental analysis values by measuring the stabilized fiber is 1.5 or more.

3. A process for producing a carbon fiber as claimed in claim 1, wherein the carbonaceous mesophase pitch has a ratio of an optical anisotropic phase of 40% or higher.

4. A process for producing a carbon fiber as claimed in claim 1, wherein the carbonaceous mesophase pitch has a softening point of 240° C. to 340° C.

5. A process for producing a carbon fiber as claimed in claim 1, wherein the pitch fiber is obtained by melt spinning the carbonaceous mesophase pitch at a temperature higher than the softening point thereof, followed by stretching at a rate of 50 to 1000 m/min, while being extruded through a nozzle having a diameter of 0.05 to 0.5 mm at a viscosity of 100 to 3000 poise.

6. A process for producing a carbon fiber as claimed in claim 1, wherein the stabilization is carried out under an oxidative atmosphere containing 1% to 10% by volume of $NO_2$, 4% to 20% by volume of $H_2O$, and 2% to 40% by volume of $O_2$ at a temperature of 150° C. to 350° C.

* * * * *